US006857519B2

(12) United States Patent
Daetweiler et al.

(10) Patent No.: US 6,857,519 B2
(45) Date of Patent: Feb. 22, 2005

(54) JEWELRY BOX WITH EARRING BOOKLET AND NECKLACE WELL

(76) Inventors: Eldon Daetweiler, 3625 Fredonia Dr. #12, Los Angeles, CA (US) 90068; Alejandra Daetweiler, 3625 Fredonia Dr. #12, Los Angeles, CA (US) 90068

( * ) Notice: Subject to any disclaimer, the term of this patent is extended or adjusted under 35 U.S.C. 154(b) by 101 days.

(21) Appl. No.: 10/385,804

(22) Filed: Mar. 11, 2003

(65) Prior Publication Data

US 2004/0178116 A1 Sep. 16, 2004

(51) Int. Cl.[7] ..... A45C 11/04
(52) U.S. Cl. ..... 206/6.1; 206/566
(58) Field of Search ..... 206/6.1, 557, 558, 206/564, 566; D3/273, 275, 283, 284, 294, 297, 903

(56) References Cited

U.S. PATENT DOCUMENTS 2,755,154 A * 7/1956 Mele ..... 312/274
4,771,206 A * 9/1988 Taylor ..... 312/135
D301,100 S * 5/1989 Lee ..... D6/560
4,978,001 A * 12/1990 Nelson ..... 206/748
4,984,854 A * 1/1991 DeLavallade ..... 312/330.1
5,358,100 A * 10/1994 Wolff ..... 206/749
D361,430 S * 8/1995 Mohundro ..... D3/297
5,511,873 A * 4/1996 Mech ..... 312/227
5,551,772 A * 9/1996 Keffer ..... 312/114
6,158,578 A * 12/2000 Greiner ..... 206/6.1
6,595,609 B1 * 7/2003 Greiner ..... 312/321.5
D485,682 S * 1/2004 Wolf ..... D3/295

* cited by examiner

*Primary Examiner*—Kurt Fernstrom
(74) *Attorney, Agent, or Firm*—Clement Cheng

(57) ABSTRACT

A jewelry box has a lower section having a full drawer, a pair of half drawers, and a ring holder. A rear panel forming a necklace well between the rear panel and the drawers of the lower section defines a rear section. A plurality of necklace hangers attached to the rear panel, a top panel forming the top of the box hinges to the rear panel and has a mirror on an inside face so that a user may lift the top panel in hinged connection to the rear panel. An upper section is formed of a pair of doors, a left door and a right door. A right door tray mounts as a bottom face located on the right door holds articles. A left door holds an earring booklet.

21 Claims, 3 Drawing Sheets

JEWELRY BOX WITH EARRING BOOKLET AND NECKLACE WELL

DISCUSSION OF RELATED ART

Jewelry boxes have a variety of compartments and drawers for holding a variety of accessories including: rings, bracelets, earrings, and necklaces. Having an ease of configuration allows a user to store, organize and retrieve items without difficulty. Although many boxes are designed with elegant exteriors, many lack a compact and simple means for storing a person's collection. In particular, costume jewelry requires an inexpensive storage means.

Many jewelry boxes include a ring holder. A ring holder may include a series of parallel grooves holding rings vertically or instead of grooves, a plurality of nubs or knobs holding rings horizontally. The knobs or nubs protrude through the opening of the ring and may be arranged in an array for convenience.

Over the years, a wide variety of configurations have been used for a wide variety of jewelry collections. Some boxes incorporate a musical box elements and mechanisms to provide music when certain doors or drawers are actuated. Many of the boxes in the past incorporate design elements at the expense of practicality. What is needed is an inexpensive storage means that can also receive a fancy exterior, but maintain user-friendly practical design elements.

DETAILED DESCRIPTION OF THE PREFERRED EMBODIMENT

Figure 1:
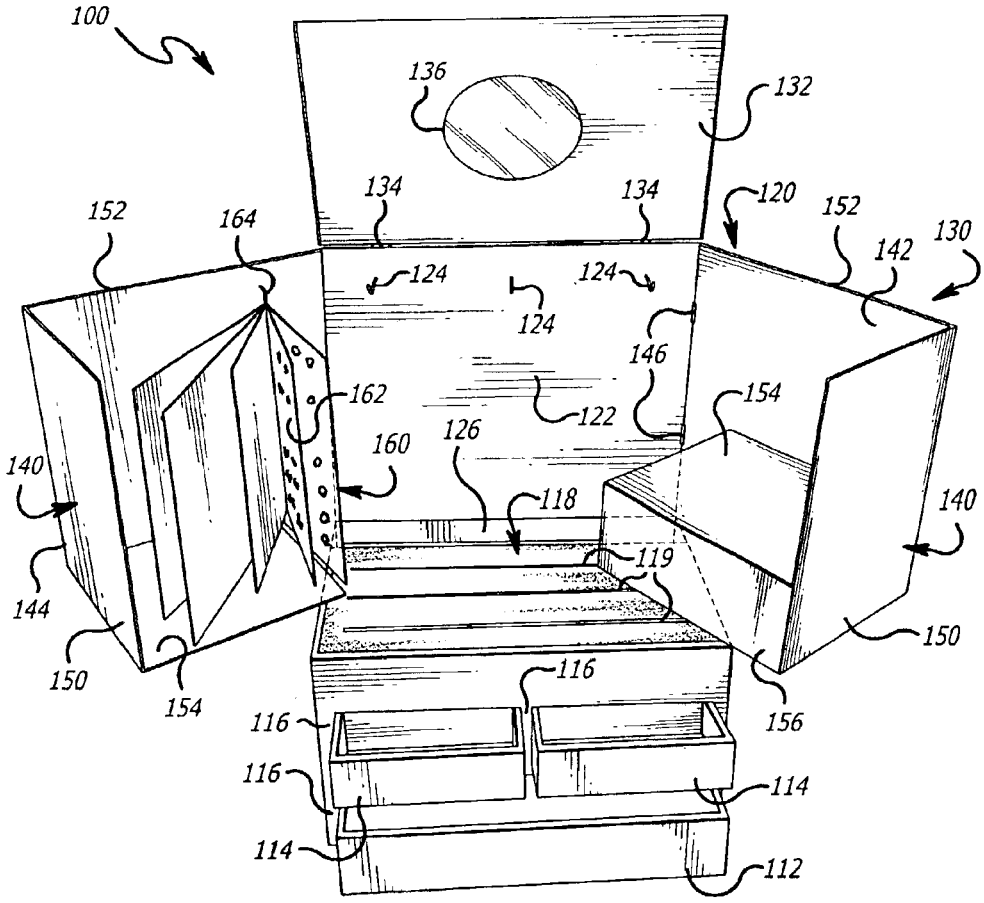
FIG. 1 is a perspective view of the box in open configuration.
Figure 2:
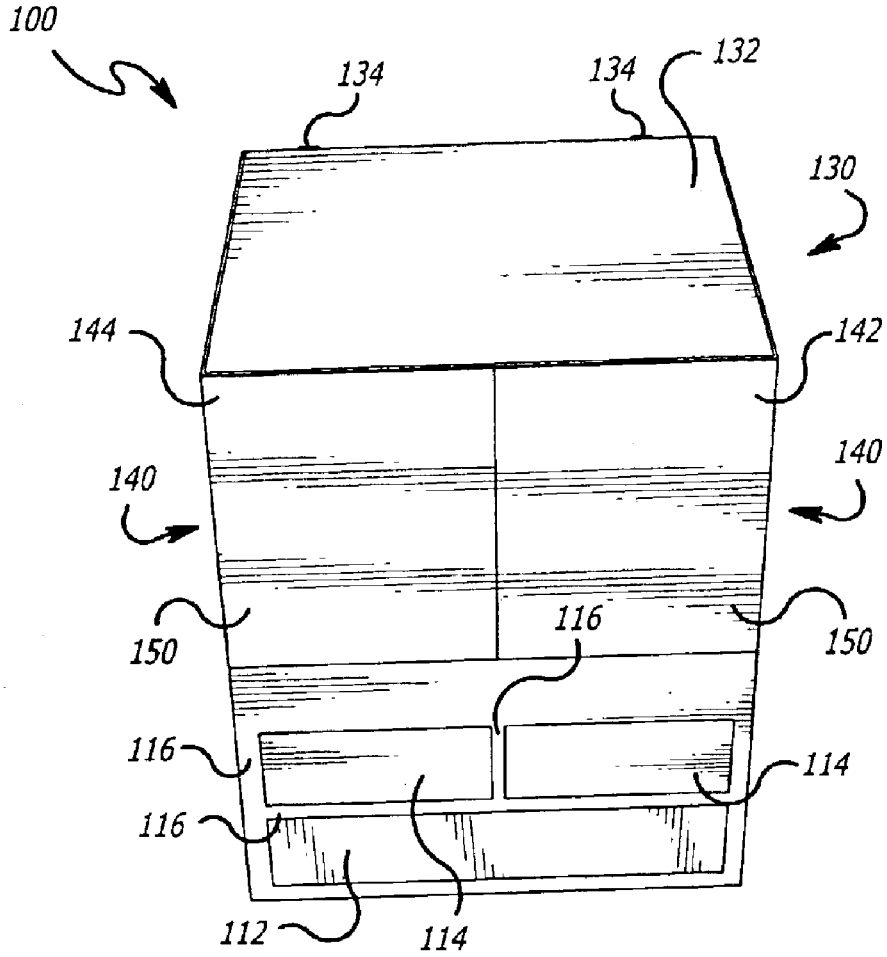
FIG. 2 is a perspective view of the box in closed configuration.
Figure 3:
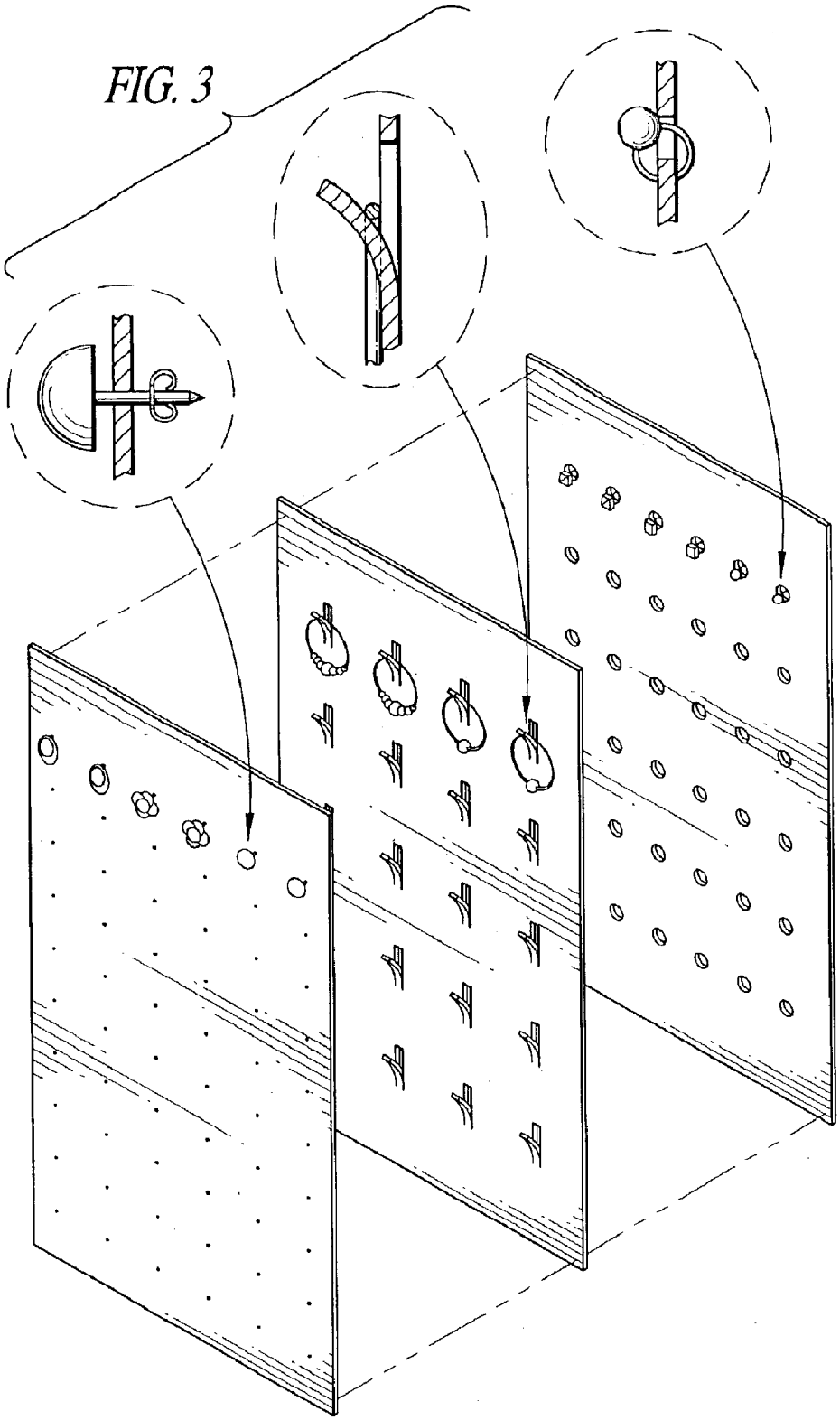
FIG. 3 is a view of earring booklet pages showing stud, loop and clip holding booklet pages.

FIG. 1. The box 100 is rectangular in shape and has a lower section 110, rear section 120 and an upper section 130.

Sliding drawers are obviously not new in the art. The following is a description and a definition of the operation and configuration of drawers according to common usage and understanding. The lower section includes a lower section compartment capable of receiving a set of sliding drawers. The lower section compartment has openings capable of receiving sliding drawers that move in and out of the openings along the horizontal plane. It is well known that sliding drawers have margins so that parallel mounted drawers do not interfere with each other, because due to play drawers do not move entirely perpendicular to the plane of the face of the lower section compartment. The sliding drawers are formed as trays to receive articles and slide from a closed position to an open position. Articles remain in the drawers shaped as trays due to gravity. A margin usually surrounds of the perimeter of the opening receiving a drawer. The margin is sized to be sufficient to prevent interference between drawers. For purposes of this invention, vertical margins and horizontal margins are distinguished and discussed separately. Oftentimes, a drawer is used in conjunction with other drawers. When a first drawer is to the left or right of another drawer, the left or right drawer is commonly the same size as the first drawer.

The lower section 110 is a three-drawer jewelry box 100 that is known in the art. The lower section comprises a full drawer 112 having a width spanning the full length of the width of the box except for margins 116 at a left and right side. Larger items such as bracelets and large brooches can be placed in the lower section full drawer 112. Half drawers 114 reside above the full drawer. Half drawers 114 have a margin between them 116 and margins 116 on a left and right side of the box.

Although a full drawer should be combined with two smaller half drawers, a full drawer may also be combined with a second full drawer. A drawer front is commonly decorated by designs. Some of these designs may include flowers, depictions of persons and geometric shapes. A variety of drawer fronts may be used such as straight, bow, serpentine, oxbow, and block. Other standard furniture techniques such as veneer can be used to decorate the exterior of the box or drawer fronts.

Above the twin half drawers, a ring holder 118 retains rings in a series of parallel grooves 119. The grooves 119 are formed from soft felt or velvet to prevent scratching or damage to gold or other soft metal. The ring holding grooves may be held in a removable tray so that a user may remove the tray and the retained ring articles for ease in handling.

Pearl necklaces scratch easily when stored and mixed with harder stones. A plurality of necklace hangers 124 can hold necklaces. Necklace holders 124 can be formed of hooks or other decorative elements such as knobs that can hold necklaces draped over the necklace holder. The necklace hangers are attached to a rear panel. The rear section compartment is a well 126 formed as a gap or void between the rear panel 122 and the drawers allow room for a necklace hanging from a necklace hanger 124 on the rear panel 122. The top of the necklace can be seen, whereas the lower portion of the necklace hangs down into the necklace well 126 behind the lower section of the jewelry box 110.

The top panel portion 132 hinged connects to the rear panel and forms to the top of the box. The top panel 132 has a mirror 136 on the inside face so that a user may lift the top panel 132 in hinged connection to the rear panel 122. The top panel 132 hinge mechanisms limits the degree of motion so that the top panel 132 may swivel from a horizontal closed position to approximately one hundred twenty degrees to an open position. Mechanical mechanisms that prevent a hinge from moving past a certain angle are well known in the art. Hinges include those that have an angle-limiting device built into the hinge. The top panel may protrude over the edge of the left and right door so that a user may grasp the edge of the top panel. The top panel may rest on a portion of the left and right door. The top panel may also include a hinge that prevents movement past a horizontal plane. The open top panel position allows a user to view worn jewelry through the reflection in the mirror 136 when the jewelry box 100 is placed on a desk or dresser. The top panel mirror 136 may be cut into a variety of various shapes such as oval, rounded or rectangular. The top panel mirror may be glued to the top panel, or be integrally formed into the top panel. Alternatively, a window that allows a user to see through the top of the jewelry box may replace the mirror.

The top section 130 is formed of a pair of doors 140, a left door 144 and a right door 142. The right door is the door facing a user's right hand and the left door is open the door facing the user's left hand. The doors 140 open above the drawers. The left and right doors open outward and are attached by hinges 146 to the rear panel so that they swivel along a horizontal plane. Each door has a front face 150 and a side face 152. The front face, bottom face and side face encompasses the inside and outside surface of the member and both sides of the planar member. The side face 152 has hinges 146 mounted vertically connecting the side face 152 to the rear panel 122. The side face 152 is permanently affixed to the front face 150 so that there is zero relative motion between the side face 152 and front face 150. The side face 152 and front face 150 are preferably joined at a ninety degrees angle so that a basically rectangular box profile may be maintained. The side face and front face are joined together with a bottom face 154 such that the bottom face 154 is perpendicular to the side face and front face. The bottom face may additionally be a door tray 156 instead of a flat planar object. The tray is preferably located on the right door 142. A door tray 156 may hold a single large item.

The left door 144 also comprises a side face 152 and front face 150 and bottom face 154, but additionally includes a booklet 160 capable of holding earrings. The booklet 160 is mounted vertically and has its opening facing the user. The booklet 160 comprises several pages. The pages 162 can be mixed and reordered at the option of the user. A user may store earrings in the pages of the booklet. Earring pages 162 are formed of a planar member having an array of holes allowing multiple stems of earrings to communicate through and attach to the member. The other pages 162 are formed of a planar member preferably resilient and punched to have an array of low profile perforated hooks. A user may hang low profile jewelry items on the plurality of hooks are arranged in an array. Therefore, the small items may be stored in the pages of the booklet. The booklet 160 may be mounted and attached to the hinge that joins the rear panel to the side face of the right door. Alternatively, the booklet may also be mounted on a bar, the booklet mounting bar 164, which attaches to the side face of the door.

The best mode regarding the booklet 160, includes three pages having an array of holes for storing and organizing stud earrings. The array of holes are spaced and organized to allow enough clearance between earrings. Earring studs pass through holes and attach to the page as they would to an ear. At least one page should store and organize loop earrings. Loop earrings have a design formed in the shape of a loop. The loop of material of the earring may be rigid, or semi rigid. The loop is commonly circular, but maybe oval shaped, or eccentrically shaped. The loop earring-holding page includes semi perforated cuts in the page that form protrusions that act as hooks capable of holding a loop earring. The loop earring holding page is preferably made of a rigid plastic sheet, capable of being machined punched to create hooks capable of hooking a loop of an earring.

The rear pages comprising at least one page and have an array of perforations capable of holding a clip on an earring. A clip earring does not pass through the flesh of an ear, and retains to an ear by clipping. A clip earring commonly has an open position and a closed position. A user stores a clip earring by preferably passing it through a perforation in the open position. A user then closes the clip earring such that it attaches to the edge of the perforation. A page may also be cut in a particular ornamental shape so that it also has a page profile allowing a plurality of clip earrings to be stored along the edge of the page. Thus, the clip earring storage locations on the clip earring storage pages may be on the edge of the page, or in locations away from the edge of the page defined by perforations. The perforations must have sufficient size to allow a clip earring to pass through. Stud, clip and hoop storage on a page are well known in the art.

A wide variety of means may be used to attach a booklet to the area near the side face of the door. A first means may encompass using a clip to attach one page of the booklet to the side face of the door. A second means may encompass using a bar that defines and axis through which the pages rotate about. A third means may encompass using a bar that attaches to the spine of a booklet. The third means attaches to a bar paralleling the axis by which the pages rotate about. A fourth means implements a tray to retain the pages of the booklet, while the booklet is standing on opened pages. The booklet may be removable from the door. The booklet mounting bar could be made straight such that it protrudes up ward from the bottom face of the door. The booklet may slide off of the booklet mounting bar. Alternatively, the booklet mounting bar may attach at an upper end to the side face of the door then bend downward to attach at a lower end to the bottom face of the door. Booklet attachment means are also well known in the art.

A mirror may also be placed on the inside surface of the rear panel so that a user may see reflections of the collection.

The material of the box can be varied. The best material known to date is thin plywood. Plywood is both lightweight and offers economical assembly. The planar members such as the back panel of the rear section can be made in thin plywood. The side face, front face and bottom face of the left and right door can also be made in the same material. The drawers may also be made out of the same material as the rear section. Obviously, the device may be made in plastic or metal as well.

The top panel hinge mechanism limits the degree of motion. Oftentimes, a piece of ribbon or cord can attach to the top panel and the back panel to prevent the top panel from swiveling past a certain angle. Similarly, the side doors of the upper section may also be limited by attaching a cord or ribbon between the rear section back panel and the side doors. The degree of motion limiting is well-known in the art, and has been in practice for thousands of years.

The foregoing describes the preferred embodiments of the invention. Modifications may be made without departing from the spirit and scope of the invention as set forth in the following claims.

What is claimed is:

1. A jewelry box comprising:

a. a lower section having a main drawer, a pair of half drawers, and a ring holder, wherein the main drawer spans the full length of the width of the box except for margins at a left and a right side, a pair of half drawers mount side by side adjacent the main drawer, the half drawers have a margin between them and margins on the left and right side of the box, wherein the ring holder forms the top of the lower section, b. a rear section defined by a rear panel forming a necklace well between the rear panel and the drawers of the lower section, c. a plurality of necklace hangers attached to the rear panel are formed as hooks or knobs, whereby they can hold necklaces draped over the necklace holder and allow room for necklaces to hang down into the necklace well behind the lower section of the jewelry box, d. a top panel forming the top of the box hinges to the rear panel e. an upper section, formed of a pair of doors, a left door and a right door, the doors opening above the drawers, wherein the left and right doors opening outwardly and attach by hinges to the rear panel so that both doors swivel along a horizontal plane, wherein both doors having a front face, a bottom face, and a side face hinge mounted vertically to connect to the rear panel, wherein the side face affixed to the front face, the side face and front face joined perpendicularly defining a basically rectangular jewelry box, wherein the side face and front face joined with a bottom face such that the bottom face is perpendicular to the side face and front face, f. a door tray mounts on the bottom face of either the right or left door and holds articles.

2. The rectangular jewelry box of claim 1, wherein the ring holder features a series of parallel ring retaining grooves forms the top of the lower section.

3. The rectangular jewelry box of claim 1, wherein the ring holder forms a removable tray featuring a series of parallel ring retaining grooves.

4. The rectangular jewelry box of claim 1, wherein a pair of half drawers mount side by side below the main drawer.

5. The rectangular jewelry box of claim 1 further comprising:

a booklet mounted vertically in the opposite door of the door tray and opens facing the user, wherein the booklet holds pages capable of holding earrings, wherein earring pages are formed of a planar member having an array of holes allowing multiple stems of earrings to communicate through and attach to the member, wherein other pages are formed of resilient planar material and punched to form an array of low profile perforated hooks, a user may hang low profile jewelry items on the plurality of hooks arranged in an array.

6. The rectangular jewelry box of claim 5, wherein the pages can be mixed and reordered at the option of the user.

7. The rectangular jewelry box of claim 5, wherein the top panel swivels approximately one hundred twenty degrees between a horizontal closed position and an open position.

8. The rectangular jewelry box of claim 5, wherein the booklet is mounted on a booklet mounting bar.

9. A jewelry box comprising:

a. a lower section having a main drawer, a pair of half drawers, and a ring holder, wherein the main drawer spans the full length of the width of the box except for margins at a left and a right side, a pair of half drawers mount side by side adjacent the main drawer, the half drawers have a margin between them and margins on the left and right side of the box, wherein the ring holder forms the top of the lower section, b. a lower section having a first main drawer, a second main drawer, and a ring holder, wherein the main drawer spans the full length of the width or the box except for margins at a left and a right side, a second main drawer mounts below the main drawer, the second main drawer has margins on the left and right side of the box, the ring holder forms the top of the lower section, c. a rear section defined by a rear panel forming a necklace well between the rear panel and the drawers of the lower section, d. a plurality of necklace hangers attached to the rear panel are formed as hooks or knobs, whereby they can hold necklaces draped over the necklace holder and allow room for necklaces to hang down into the necklace well behind the lower section of the jewelry box, e. a top panel forming the top of the box hinges to the rear panel, f. an upper section, formed of a pair of doors, a left door and a right door, the doors opening above the drawers, the left and right doors opening outwardly and attach by hinges to the rear panel so that both doors swivel along a horizontal plane, both doors having a front face, a bottom face, and a side face hinge mounted vertically to connect to the rear panel, the side face affixed to the front face, the side face and front face joined perpendicularly defining a basically rectangular jewelry box, the side face and front face are joined together with a bottom face such that the bottom face is perpendicular to the side face and front face, a right door tray mounted as a bottom face located on the right door holds articles.

10. The rectangular jewelry box of claim 9, wherein the ring holder features a series of parallel ring retaining grooves forms the top of the lower section.

11. The rectangular jewelry box of claim 9, wherein the ring holder forms a removable tray featuring a series of parallel ring retaining grooves.

12. The rectangular jewelry box of claim 9, wherein a pair of half drawers mount side by side below the main drawer.

13. The rectangular jewelry box of claim 12, further comprising:

a booklet mounted vertically in the opposite door of the door tray and opens facing the user, the booklet holds earring pages resilient planar material including: stud earring pages having a stud hole array allowing multiple studs of earrings to communicate through and attach to the stud earring page; loop earring pages perforated to form an array of low profile protrusions that operate as hooks to allow a user to hang loop earrings on the hook array; clip earring pages having an array of holes to allow a user to clip her clip earrings on array of holes.

14. The rectangular jewelry box of claim 12, wherein pages can be mixed and reordered at the option of the user.

15. The rectangular jewelry box of claim 12, wherein the top panel swivels approximately one hundred twenty degrees between a horizontal closed position and an open position.

16. The rectangular jewelry box of claim 12, wherein the booklet is mounted by a booklet mounting bar.

17. A jewelry box comprising:

a. a lower section having two rows of drawers, and one ring holder above the two rows of drawers, wherein the one ring holder forms the top of the lower section, b. a rear section defined by one rear panel forming one necklace well between the rear panel and the drawers of the lower section, c. a plurality of necklace hangers attached to the rear panel are formed as hooks or knobs, whereby they can hold necklaces draped over the necklace holder and allow room far necklaces to hang down into the necklace well behind the lower section of the jewelry box, d. a top panel forming the top of the box hinges to the rear panel so that a user may lift the top panel in hinged connection to the rear panel, the top panel hinge mechanism limits the degree of motion so that the top panel may swivel from a horizontal closed position to an open position, e. an upper section, formed of a pair of doors, a left door and a right door, the doors opening above the lower section, the left and right doors opening outwardly and attach by hinges to the rear panel so that both doors swivel along a horizontal plane, both doors have a front face, a bottom face, and a side face, both doors hinge mounted vertically to connect to the rear panel, the side face affixed to the front face, the side face and front face joined perpendicularly defining a basically rectangular jewelry box, the side face and front face are joined together with a bottom face such that the bottom face is perpendicular to the side face and front face, a door tray mounted as a bottom face holds articles, f. an earring booklet mounted vertically in the opposite door of the door tray and opens facing the user, the booklet holds earring pages made of resilient planar material including: stud earring pages having a stud hole array allowing multiple studs of earrings to communicate through and attach to the stud earring page; loop earring pages perforated to form an array of low profile protrusions that operate as hooks to allow a user to hang loop earrings on the hook array; clip earring pages having an array of holes to allow a user to clip her clip earrings on array of holes.

18. The rectangular jewelry box of claim 17, wherein the earring booklet is mounted in the right door and the door tray is mounted in the left door.

19. The rectangular jewelry box of claim 17, wherein the top panel swivels approximately one hundred twenty degrees between a horizontal closed position and an open position.

20. The rectangular jewelry box of claim 17, wherein the booklet mounting means is a booklet mounting bar.

21. The rectangular jewelry box of claim 17, wherein the earring booklet is mounted in the left door and the door tray is mounted in the right door.

* * * * *